United States Patent [19]

Galle, Jr.

[11] 4,421,164

[45] Dec. 20, 1983

[54] WEIGHT-SET PACK-OFF UNIT

[75] Inventor: Edward M. Galle, Jr., Houston, Tex.

[73] Assignee: Armco Inc., Middletown, Ohio

[21] Appl. No.: 316,395

[22] Filed: Oct. 29, 1981

[51] Int. Cl.[3] ..... F21B 23/00; F16L 35/00

[52] U.S. Cl. ..... 166/118; 285/139; 285/18

[58] Field of Search ..... 166/118, 85; 285/139, 285/18, 3, 4, 39, 308, 321, 334.3, 338, 341, 347, 348

[56] References Cited

U.S. PATENT DOCUMENTS

| | | | |
|---|---|---|---|
| 3,268,241 | 8/1966 | Castor et al. | 285/139 |
| 3,404,736 | 10/1968 | Nelson et al. | 166/85 |
| 3,457,992 | 7/1969 | Brown | 166/6 |
| 3,789,925 | 2/1974 | Brown | 166/125 |
| 3,972,546 | 8/1976 | Putch | 285/18 |
| 4,138,144 | 2/1979 | Pierce, Jr. | 285/18 |

*Primary Examiner*—Ernest R. Purser
*Assistant Examiner*—Thuy M. Bui
*Attorney, Agent, or Firm*—Roylance, Abrams, Berdo & Goodman

[57] ABSTRACT

A weight-set pack-off unit for sealing the annulus between inner and outer pipes, such as a mandrel casing hanger and a wellhead body in a well. The pack-off unit includes an expandable split ring receivable in a groove in the outer pipe to prevent upward movement of the pack-off unit relative to the outer pipe. The split ring is supported by a second ring which is shear-pinned to the pack-off unit and which moves the split ring into the locking position. The pack-off unit has a downwardly facing load-bearing shoulder in engagement with an upwardly facing load-bearing shoulder on the inner pipe, thereby increasing the unit's capacity to carry downward loads.

13 Claims, 4 Drawing Figures

WEIGHT-SET PACK-OFF UNIT

FIELD OF THE INVENTION

The invention relates to a weight-set pack-off unit for sealing the annulus between inner and outer pipes, such as a mandrel casing hanger and a wellhead body in a well. The unit includes a locking assembly for preventing upward movement of the pack-off unit relative to the outer pipe. The unit is in a load-bearing relationship with the inner pipe, thereby increasing the unit's capacity to carry downward loads.

BACKGROUND OF THE INVENTION

Weight-set pack-off units are well known in the art for sealing the annulus between an inner and an outer pipe, such as a mandrel casing hanger and a wellhead body in a well. Examples of such pack-off units are shown in U.S. Pat. No. 3,268,241 to Castor et al.; U.S. Pat. No. 3,972,546 to Putch; and U.S. Pat. No. 4,138,144 to Pierce, Jr.

However, there are various disadvantages with the known prior art pack-off units. In the first place, the upward load capacity of these units in the event that the unit seals pressure from the bottom of the well is limited, mostly due to the locking mechanism of the pack-off unit to the outer wellhead body. While various types of pipe or pack-off locking mechanisms are known in the art, these are usually complicated to manufacture and use. Examples are shown in U.S. Pat. No. 3,404,736 to Nelson et al.; U.S. Pat. No. 3,457,992 to Brown; and U.S. Pat. No. 3,789,925 to Brown. In addition, the pack-off units of the prior art have a limited capacity to carry downward loads, with the typical configuration having the load carried through the weight-set resilient packing.

SUMMARY OF THE INVENTION

Accordingly, a primary object of the invention is to provide an improved weight-set pack-off unit with an improved upward load capacity.

Another object of the invention is to provide a pack-off unit having a positive locking mechanism that is easily manufactured and used to increase the upward load capacity of the unit.

Another object of the invention is to provide such a pack-off unit with a downwardly facing load-bearing shoulder engagable with an inner pipe to increase the unit's capacity to carry downward loads.

The foregoing objects are basically attained by providing a weight-set pack-off unit for sealing the annulus between an inner pipe received in an outer pipe, the combination comprising an inwardly facing groove in the outer pipe; an upwardly facing shoulder on the inner pipe; a pack-off body having an annular weight-set packing received thereon and an annular actuating member releasably coupled to the pack-off body below the weight-set packing which is moved into engagement with the weight-set packing upon contact thereof with the upwardly facing shoulder on the inner pipe; an expandable annular locking means, receivable in the groove in the outer pipe, for the locking the pack-off body to the outer pipe and preventing upward movement of the pack-off unit relative to the outer pipe; and ring means, releasably couped to the pack-off body above the weight-set packing, for supporting the locking means above the weight-set packing and for moving the locking means into and out of the groove in the outer pipe.

Advantageously, the expandable annular locking means is a split ring and the ring means is a solid ring shear-pinned to the pack-off body and slidably coupled to the split ring locking means.

In addition, the inner pipe has a second upwardly facing shoulder engageable with a downwardly facing load-bearing shoulder on the pack-off body to increase the unit's capacity to carry downward loads.

Other objects, advantages and salient features of the present invention will become apparent from the following detailed description, which, taken in conjunction with the annexed drawings, discloses a preferred embodiment of the invention.

DRAWINGS

Referring now to the drawings which form a part of this original disclosure:

DETAILED DESCRIPTION OF THE INVENTION

Figure 1:
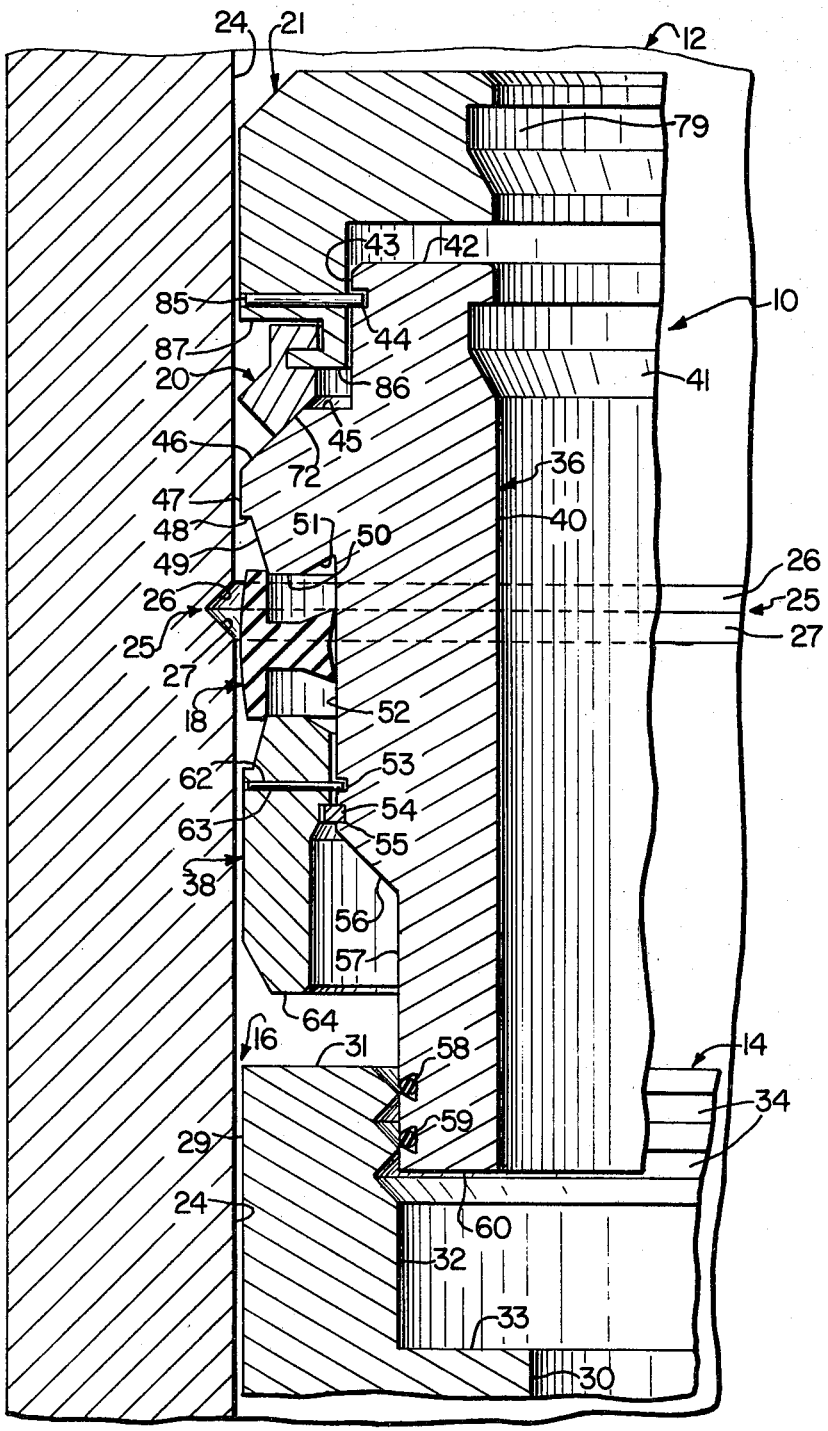
FIG. 1 is a fragmentary vertical cross-sectional view of the pack-off unit in accordance with the invention received inside an outer pipe and about to be landed on the inner pipe.
Figure 2:
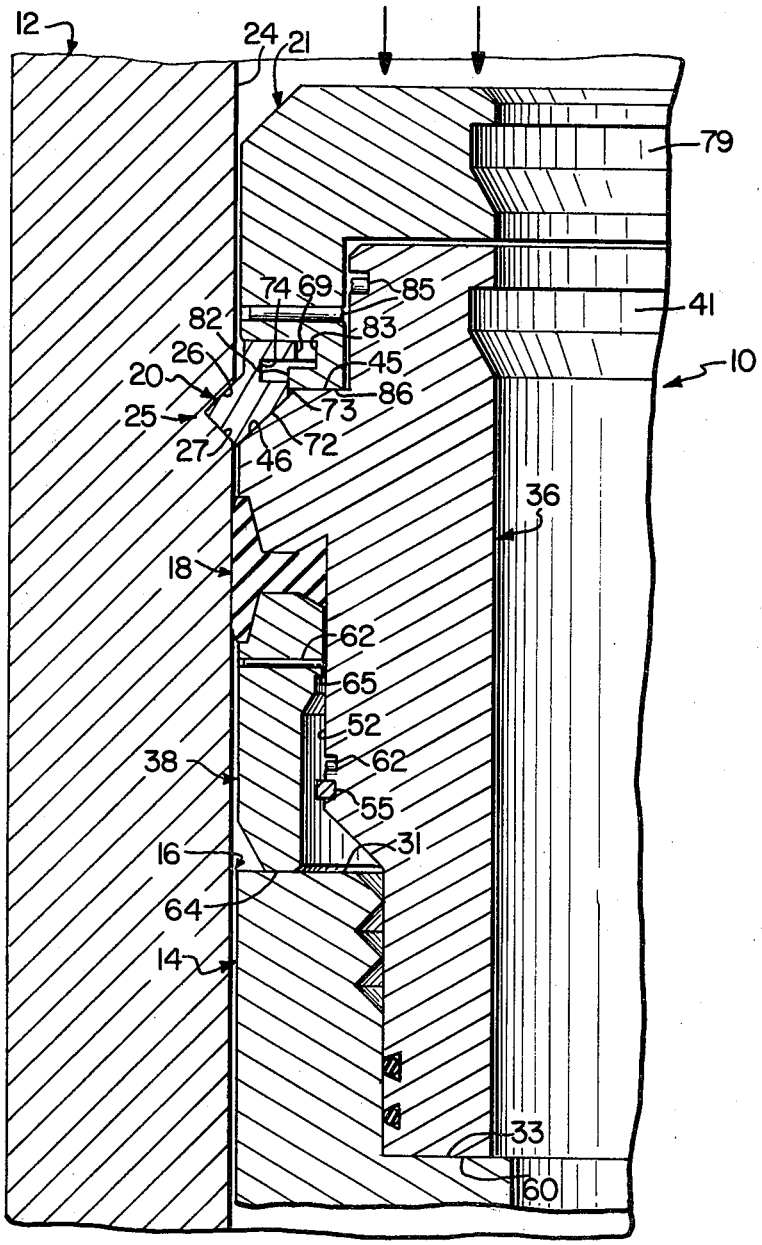
FIG. 2 is a view similar to that shown in FIG. 1 except that the pack-off unit is fully landed on the inner pipe, the packing has been actuated into a sealing position, and the locking means has been moved into a locking position.

Referring now to FIGS. 1–4, the weight-set pack-off unit 10 is shown inside an outer pipe 12 and about to be landed on an inner pipe 14, which is conventionally secured to the outer pipe against relative movement. The purpose of the pack-off unit is to seal the annulus 16 between the inner and outer pipes by means of the packing 18, as shown in FIG. 2. Typically, the outer pipe is a wellhead body and the inner pipe is a mandrel casing hanger used in a well, the casing hanger intended to support a plurality of casings in the well.

As seen in FIGS. 1 and 2, a split locking ring 20 is utilized to lock the pack-off unit to the outer pipe with a second ring 21 supporting and actuating the locking ring. This second ring is releasably coupled to the pack-off unit itself.

Referring now to FIG. 1, the outer pipe 12 has a cylindrical inner surface 24 defining a through bore and is interrupted by an inwardly facing annular groove 25 having an upwardly and inwardly tapering frustoconical upper surface 26 and a downwardly and inwardly tapering frustoconical lower surface 27. Both of these surfaces taper at about 45 degrees.

The inner pipe 14, rigidly coupled to the outer pipe by conventional means to prevent relative movement therebetween, has an outer cylindrical surface 29, an inner cylindrical surface 30 defining a through bore and an upwardly facing annular surface 31, which is a load bearing shoulder. In addition, the inner pipe 14 is counter-bored forming a second inner cylindrical surface 32 and a second upwardly facing annular surface 33 between cylindrical surfaces 30 and 32. Annular surface 33 is also a load-bearing shoulder. At the top of cylindrical surface 32 are a plurality of handling grooves 34 for releasable connection to a conventional handling tool for raising and lowering the inner pipe.

As seen in FIG. 1, the annulus 16 is defined between the outer cylindrical surface 29 of the inner pipe and the inner cylindrical surface 24 of the outer pipe.

The pack-off unit 10 comprises a tubular pack-off body 36, an annular actuating member 38 for setting the packing 18 and the packing 18 itself.

The pack-off body 36 has a cylindrical through-bore 40 with a handling groove 41 at the top thereof. This handling groove is basically used to remove the pack-off unit from the outer pipe. The pack-off body 36 has an upwardly facing annular shoulder 42 at the top which extends into a cylindrical surface 43 on the outside of the body, this cylindrical surface being interrupted by an annular groove 44 having a substantially rectangular cross-section. Extending from cylindrical surface 43 is an upwardly facing annular shoulder 45 which extends into an upwardly and inwardly tapering frustoconical surface 46. This surface tapers at about 45 degrees and extends into a cylindrical surface 47. This cylindrical surface extends into a downwardly facing annular surface 48 which in turn extends into a downwardly and inwardly tapering frustoconical surface 49. Surface 49 extends into a downwardly facing annular surface 50 which in turn extends into an upwardly and inwardly tapering frustoconical surface 51. Surface 51 extends into an outwardly facing cylindrical surface 52 having a pair of annular grooves 53 and 54 near the bottom thereof. These grooves have substantially rectangular cross-sections with groove 54 receiving therein a ring 55 having a substantially rectangular cross-section and having a portion extending outwardly from cylindrical surface 52. Below groove 54, cylindrical surface 52 extends into a downwardly and inwardly tapering frustoconical surface 56 which extends into a cylindrical surface 57. This cylindrical surface 57 has suitable grooves therein for receiving O-rings 58 and 59. At the bottom of the pack-off body 36 is a downwardly facing annular shoulder 60 which extends into the cylindrical surface 57. This annular shoulder 60 is a load-bearing shoulder for engagement with annular shoulder 33 on the inner pipe, as shown in FIG. 2.

The actuating member 38 is in the form of a ring and has a plurality of horizontally oriented bores 62 therein for the reception of a plurality of, preferably six, shear-pins 63 whose ends extend inwardly of the actuating member 38 and are received in groove 53 in the pack-off body 36, thereby releasably connecting the actuating member to the pack-off body. The actuating member has a downwardly facing annular shoulder 64 for engagement with annular shoulder 31 on the inner pipe. When the pack-off unit 10 is moved downwardly so that shoulder 64 contacts shoulder 31, the shear-pins 63 break, allowing the actuating member 38 and the pack-off body 36 to compress packing 18. This is accomplished by having the upper surface of the actuating member 38 contact the bottom of the packing 18 and by having the downwardly directed surfaces 48, 49, 50 and 51 of the pack-off body 36 contact the top of the packing as seen in FIG. 2. In this regard, the upper surface of the actuating member 38 has a configuration similar to that of surfaces 48–51 but in a mirror image. As is known, compression of the packing 18 causes an outward bulging thereof into a sealing engagement with the inner cylindrical surface 24 of the outer pipe 12. This, in combination with O-ring seals 58 and 59, seals the annulus 16.

As seen in FIG. 2, the actuating member 38 has a downwardly facing shoulder 65 adjacent cylindrical surface 52 in the pack-off body which is engaged by the ring 55 on the body when the body is moved upwardly. This is used during retrieval of the pack-off unit.

Figure 4:
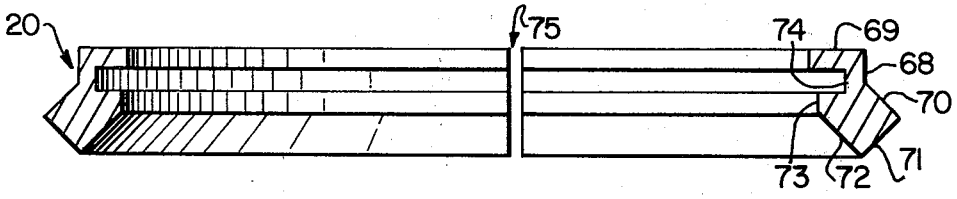
FIG. 4 is a vertical cross-sectional view of the locking ring.

Referring now to FIG. 4, the split locking ring 20 has a central right cylindrical member 68 with a radially inwardly facing annular flange 69 extending therefrom. From the cylindrical member 68 the ring has an upwardly and inwardly tapering frustoconical surface 70 which extends into a downwardly and inwardly tapering frustoconical surface 71. Both of these surfaces extend at an angle of about 45 degrees and are intended to engage surfaces 26 and 27 in groove 25 in the outer pipe. Extending from surface 71 is an upwardly and inwardly tapered frustoconical surface 72 which is in slidable engagement with frustoconical surface 46 on the pack-off body. Extending from surface 72 is a right cylindrical surface 73 having a diameter larger than the diameter of flange 69. Between the flange 69 and the main body portion of the ring defined by surfaces 70–73 is an upwardly facing horizontally oriented annular groove 74. Ring 20 is split at 75 so that it can be biased outwardly by ring 21 as shown in FIG. 2.

Ring 21 both supports and actuates locking ring 20 and is releasably coupled to pack-off body 36.

Figure 3:
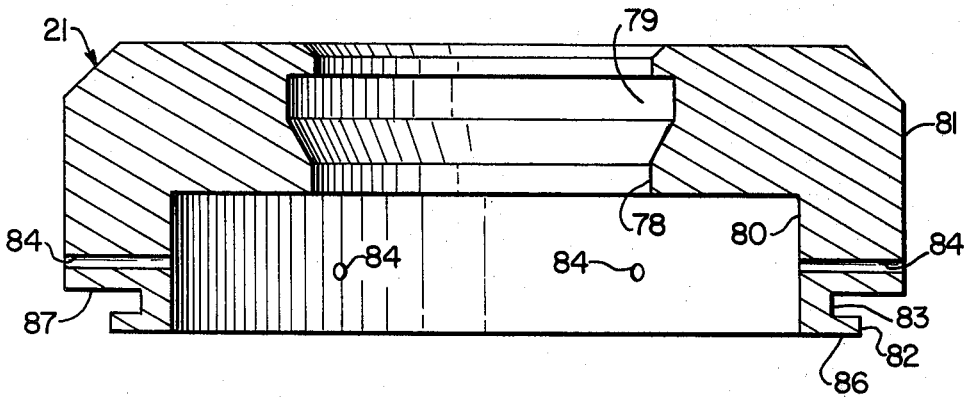
FIG. 3 is a vertical cross-sectional view of the ring used to support and actuate the locking ring.

As seen in FIG. 3, ring 21 is an annular body having a right cylindrical through-bore 78 with a handling groove 79 at the top and a right cylindrical counter-bore 80 at the bottom. The ring has an outer cylindrical surface 81 and an outwardly facing annular flange 82 with a smaller outer diameter than surface 81 at the very bottom opposite the bottom of counter-bore 80, this flange defining with a downwardly facing annular shoulder 87 of the ring an outwardly facing horizontally oriented annular groove 83. A plurality of bores 84, preferably six, extend completely through the ring from cylindrical surface 80 to cylindrical surface 81. These bores receive therein a plurality of shear-pins 85 as seen in FIG. 1, to releasably secure ring 21 to the pack-off body 36. This is accomplished by having the ends of the shear-pins 85 received in groove 44 in the pack-off body. Preferably, the strength of shear-pins 85 or their number is greater than the strength or number of the lower shear-pins 63 connecting the actuating member 38 to the pack-off body. Thus, the lower shear-pins 63 will break under less force than required to break shear-pins 85. In this way, when the pack-off unit 10 is landed on the inner pipe, the actuating member compresses the packing 18 slightly before ring 21 is moved downwardly to actuate the split locking ring 20 into its locking position.

As seen in FIGS. 1 and 2, the inwardly directed flange 69 on locking ring 20 is slidably received in outwardly facing groove 83 in ring 21 and similarly outwardly facing flange 82 on ring 21 is slidably received in inwardly facing groove 74 in the locking ring 20. In the run-in position, shear-pins 85 are connected to the pack-off body and the frustoconical surface 72 at the bottom of locking ring 20 engages frustoconical surface 46 on the pack-off body. In addition, the downwardly facing annular shoulder 86 at the bottom of ring 21 is spaced from annular shoulder 45 on the pack-off body. Similarly, the actuating member 38 is shear-pinned to the pack-off body 36 and is spaced below packing 18.

OPERATION

As shown in FIG. 1, the assembled combination of the pack-off unit 10, the locking ring 20 and the supporting and actuating ring 21 are run through the outer pipe 12 towards the inner pipe 14, which is rigidly secured to the outer pipe.

Upon continued downward movement of the pack-off unit, the downwardly facing annular shoulder 64 on the actuating member contacts the upwardly facing annular shoulder 31 on the inner pipe, breaking shear-pins 63 and compressing the packing 18 between the pack-off body 36 and the actuating member 38 which now abuts the inner pipe. Preferably, the combined pack-off unit 10, locking ring 20 and ring 21 are lowered by a handling tool gripping ring 21 via handling groove 79. Thus, after the actuating member 38 is landed on the inner pipe, the downwardly facing annular shoulder 60 on the bottom of the pack-off body 36 bottoms-out and engages, in a load-bearing relationship, the upwardly facing annular surface 33 on the inner pipe. Such bottoming-out of the pack-off body then causes shear-pins 85 to break due to the weight and momentum of the handling tool and ring 21. These shear-pins 85 thus break after shear-pins 63 since pins 85 require a larger force.

In all events, once shear-pins 85 break, downward movement of ring 21, with shoulder 87 of the ring engaging flange 69 of the locking ring, causes a corresponding outward and downward movement and bias of the locking ring 20 as frustoconical surface 72 thereon slides along frustoconical surface 46 in the pack-off body, flange 69 slides outwardly in groove 83, and groove 74 slides away from flange 82. This outward and downward movement continues until the frustoconical surfaces 70 and 71 on ring 20 are received in and engage frustoconical surfaces 26 and 27 in the locking groove 25 in the outer pipe and shoulder 86 on the ring 21 contacts shoulder 45 on the pack-off body. In addition, the outer surface of flange 82 abutts the inner surface 73 of the locking ring 20, to lock it into the position shown in FIG. 2. In this condition, the pack-off unit resists upward loads since it is locked to the outer pipe.

To retrieve the pack-off unit, ring 21 is gripped in handling groove 79 by a conventional handling tool and pulled upwardly. This also brings the split locking ring 20 out of its locking position since flanges 82 and 69 are engaged as shown in FIG. 2 and during the locking and unlocking movement of the locking ring 20, these flanges are in a slidable relationship.

After the locking ring 20 and ring 21 are removed, a handling tool can be used to grip the pack-off unit 10 by means of handling groove 41 and retrieve it.

While one advantageous embodiment has been chosen to illustrate the invention, it will be understood by those skilled in the art that various changes and modifications can be made therein without departing from the scope of the invention as defined in the appended claims. For example, rather than using a single unitary flange 69 on the locking ring 20, a plurality of individual fingers or ribs can be utilized. In addition, ring 20 can have a plurality of outwardly facing locking ribs.

What is claimed is:

1. A weight-set pack-off unit for sealing the annulus between an inner pipe received in an outer pipe, the combination comprising:

an inwardly facing groove in the outer pipe;

an upwardly facing shoulder on the inner pipe;

a pack-off body having an annular weight-set packing received thereon and an annular actuating member coupled to said pack-off body below said weight-set packing for upward slidable movement into engagement with said weight-set packing upon landing of said actuating member on said upwardly facing shoulder on the inner pipe as a result of downward movement of said pack-off body longitudinally of the outer pipe;

expandable annular locking means, receivable in said groove in the outer pipe, for locking said pack-off body to the outer pipe and preventing upward movement of the pack-off unit relative to the outer pipe; and a ring, coupled to said pack-off body above said weight-set packing, for supporting said locking means above said weight-set packing and for moving said locking means into and out of said groove in the outer pipe by downward and upward movement, respectively, of said ring longitudinally of the outer pipe.

2. A pack-off unit according to claim 1, wherein said groove has an upwardly and inwardly tapering frustoconical surface and a downwardly and inwardly tapering frustoconical surface.

3. A pack-off unit according to claim 2, wherein said frustoconical surfaces taper at about 45 degrees.

4. A pack-off unit according to claim 1, wherein said locking means has an upwardly and inwardly tapering frustoconical surface and a downwardly and inwardly tapering frustoconical surface.

5. A pack-off unit according to claim 4, wherein said frustoconical surfaces taper at about 45 degrees.

6. A pack-off unit according to claim 1, wherein said locking means is a split ring having an upwardly and inwardly tapering frustoconical support surface, and said pack-off body has an upwardly and inwardly tapering frustoconical surface engaging said support surface on said split ring locking means.

7. A pack-off unit according to claim 1, and further comprising a second upwardly facing load-bearing shoulder on the inner pipe, and a downwardly facing load-bearing shoulder on said pack-off body engageable with said second upwardly facing shoulder on the inner pipe.

8. A pack-off unit according to claim 1, wherein said ring is releasably coupled to said pack-off body by a plurality of frangible members.

9. A pack-off unit according to claim 1, wherein said locking means is a split ring.

10. A weight-set pack-off unit for sealing the annulus between an inner pipe received in an outer pipe, the combination comprising:

an inwardly facing groove in the outer pipe;

an upwardly facing shoulder on the inner pipe;

a pack-off body having an annular weight-set packing received thereon and an annular actuating member releasably coupled to said pack-off body below said weight-set packing which is moved into engagement with said weight-set packing upon contact thereof with said upwardly facing shoulder on the inner pipe;

expandable annular locking means, receivable in said groove in the outer pipe, for locking said pack-off body to the outer pipe and preventing upward movement of the pack-off unit relative to the outer pipe; and ring means, coupled to said pack-off body above said weight-set packing, for supporting said locking means above said weight-set packing and for moving said locking means into and out of said groove in the outer pipe, said ring means having an outwardly facing flange at the bottom thereof and an outwardly facing groove above the flange, and said locking means having an inwardly facing flange at the top thereof and an inwardly facing groove below the flange, said ring means flange being received in said locking means groove, said locking means flange being received in said ring means groove.

11. A weight-set pack-off unit for sealing the annulus between an inner pipe received in an outer pipe, the combination comprising:

an inwardly facing groove in the outer pipe;

first and second upwardly facing shoulders on the inner pipe;

a unitary pack-off body having an annular weight-set packing received thereon and an annular actuating member coupled to said pack-off body below said weight-set packing for upward slidable movement into engagement with said weight-set packing upon landing of said actuating member on said first upwardly facing shoulder on the inner pipe as a result of downward movement of said pack-off body longitudinally of the outer pipe;

expandable annular locking means, receivable in said groove in the outer pipe, for locking said pack-off body to the outer pipe and preventing upward movement of the pack-off unit relative to the outer pipe; and a downwardly facing load-bearing shoulder on said pack-off body engageable with said second upwardly facing shoulder on the inner pipe.

12. A method of sealing the annulus between an inner pipe received in an outer pipe, comprising the steps of lowering into the outer pipe a pack-off body having an annular weight-set packing received thereon and an annular actuating member releasably coupled to the pack-off body below the weight-set packing, landing the annular actuating member on a first upwardly facing shoulder on the inner pipe and engaging the actuating member with the weight-set packing by continued downward movement of the pack-off body, and continuing such downward movement of the pack-off body until a downwardly facing shoulder thereon lands on a second upwardly facing shoulder on the inner pipe.

13. The method according to claim 12, and further comprising the step of positively driving an expandable locking member coupled to the pack-off body into an inwardly facing groove in the outer pipe to lock the pack-off body in place relative to the inner and outer pipes by downwardly moving a ring member along the pack-off body which ring member engages the expandable locking member.

* * * * *